United States Patent [19]

Born et al.

[11] 4,017,219

[45] Apr. 12, 1977

[54] CONTROL SYSTEM FOR VARIABLE DISPLACEMENT PUMPS

[75] Inventors: Ellis H. Born, Columbus; David L. Thurston, Ashley, both of Ohio

[73] Assignee: Abex Corporation, New York, N.Y.

[22] Filed: Dec. 22, 1975

[21] Appl. No.: 642,886

[52] U.S. Cl. ..... 417/216; 60/428; 60/444; 60/447; 60/449

[51] Int. Cl.[2] ..... F04B 49/00; F16D 31/02

[58] Field of Search ..... 60/428, 429, 443, 444, 60/447, 449; 417/216, 218, 222, 426, 429

[56] References Cited

UNITED STATES PATENTS

| | | | |
|---|---|---|---|
| 3,732,036 | 5/1973 | Busbey et al. | 417/216 |
| 3,795,107 | 3/1974 | Ward | 60/428 |
| 3,886,741 | 6/1975 | Ward | 60/449 |
| 3,891,354 | 6/1975 | Bosch | 417/216 |
| 3,898,811 | 8/1975 | Seaberg | 60/428 |
| 3,963,378 | 6/1976 | McMillan | 417/216 |

*Primary Examiner*—Carlton R. Croyle
*Assistant Examiner*—G. P. LaPointe
*Attorney, Agent, or Firm*—Thomas S. Baker, Jr.; David A. Greenlee

[57] ABSTRACT

In a hydraulic system having a plurality of variable displacement pumps driven by a prime mover, each pump has a variable ratio input device connected to a load sensing means. Each variable ratio input device automatically reduces the displacement of its respective pump by the same proportion when the prime mover is overloaded irrespective of the displacement setting of the pump and automatically increases the displacement of its pump by the same proportion up to the set displacement when the prime mover is not overloaded.

6 Claims, 11 Drawing Figures

PRIME MOVER
P
R
R
R
R
10
10
11
12
13
14
15
16
19

6
6

CONTROL SYSTEM FOR VARIABLE DISPLACEMENT PUMPS

BACKGROUND OF THE INVENTION

I. FIELD OF INVENTION

The instant invention relates to a control system for automatically adjusting the displacement of a plurality of variable displacement pumps which are driven by a prime mover.

II DESCRIPTION OF THE PRIOR ART

It is common for a prime mover to drive a plurality of variable displacement pumps which are capable of demanding and using more horsepower than the prime mover can provide. As a minimum requirement, it is necessary to provide a control system which will act to reduce the displacement of some or all of the pumps when the prime mover approaches an overloaded condition in order to prevent it from stalling. Such control sytems are well known.

In one control system, shown in U.S. Pat. No. 3,723,026 to Soyland, the collective pump working pressures exert a force on a valve. If the force exceeds a predetermined value the valve passes pressure fluid to the pilot stages of valves which operate to disconnect one or more constant volume pumps or to control pistons which operate to reduce the displacement of one or more variable displacement pumps.

In another control system, shown in U.S. Pat. No. 3,841,795 to Ferre et al., a fixed displacement pump driven by a prime mover, which also drives a plurality of variable displacement pumps, supplies fluid to an underspeed control valve. When the prime mover begins to slow down from overloading, the underspeed valve shifts to pass pressure fluid from the fixed displacement pump to servo-control valves which set the displacement of variable displacement pumps. These valves reduce the displacement of the pumps until the overload is eliminated.

A third control system, shown in U.S. Pat. No. 3,649,134 to Wagenseil, discloses a plurality of variable displacement pumps driven by a prime mover which drives a centrifugal governor. When the speed of the prime mover decreases due to overloading, the governor operates a valve which passes working pressure fluid from one of the pumps to spring biased pistons which reduce the displacement of the pumps.

Although the prior art control systems act to prevent the prime mover from stalling they do not change the displacement of all the variable displacement pumps proportionally. It is desirable to have a system which changes the displacement of all variable displacement pumps proportionally (i.e., the displacements of all of the pumps are reduced in proportion to the setting of the individual manual displacement controls) so that the speeds of all of the consumers are diminished proportionally when the prime mover is overloaded. Such a system is essential, for example, when two pumps driven by a prime mover drive fluid motors on opposite tracks of a tracklaying vehicle. If one track is in mud and slipping and the other is on hard ground, the pump supplying the motor of the former must displace more fluid thereto in order to keep the vehicle moving in a straight line. If the prime mover becomes overloaded, the displacements of the two pumps have to be reduced proportionally (by the same percentage) in order that the proportions of their fluid flows will remain constant and the vehicle will continue in a straight line.

In Soyland and Wagenseil, mentioned above, a control valve passes pressure fluid to spring biased control pistons when the prime mover is overloaded. The pistons are connected to the displacement varying mechanisms of the pumps and operate against the springs to reduce the displacement of the pumps. With this arrangement, if the pump displacements are different, they cannot be reduced uniformly by the same percentage. This is because when the pumps are at different displacements the spring forces on the control pistons are different. Consequently, when pressure fluid acts on the pistons, the one with the least spring force exerted thereon will move first and the displacement of its pump will be reduced disproportionally with respect to the other pumps.

SUMMARY OF THE INVENTION

The instant invention provides a control system for a plurality of manually adjustable variable displacement pumps driven by a prime mover which automatically reduces the set displacement of all pumps proportionally (by the same percentage) regardless of their relative displacement when the prime mover becomes overloaded. When the overload condition ceases, the pump displacements are increased proportionally until the set displacement of each pump is reached.

In the instant control system, a prime mover drives a plurality of variable displacement pumps and a constant volume pump having signal pressure output which changes in proportion to the load on the prime mover. Each variable displacement pump has an independent control for selectively setting the displacement of the pump. The signal pressure output is connected to each independent control. Each control responds to the signal pressure output to proportionally change the displacement of each pump independently of its set displacement.

DESCRIPTION OF THE PREFERRED EMBODIMENT

Figures 1, 4, 8A, 8B:
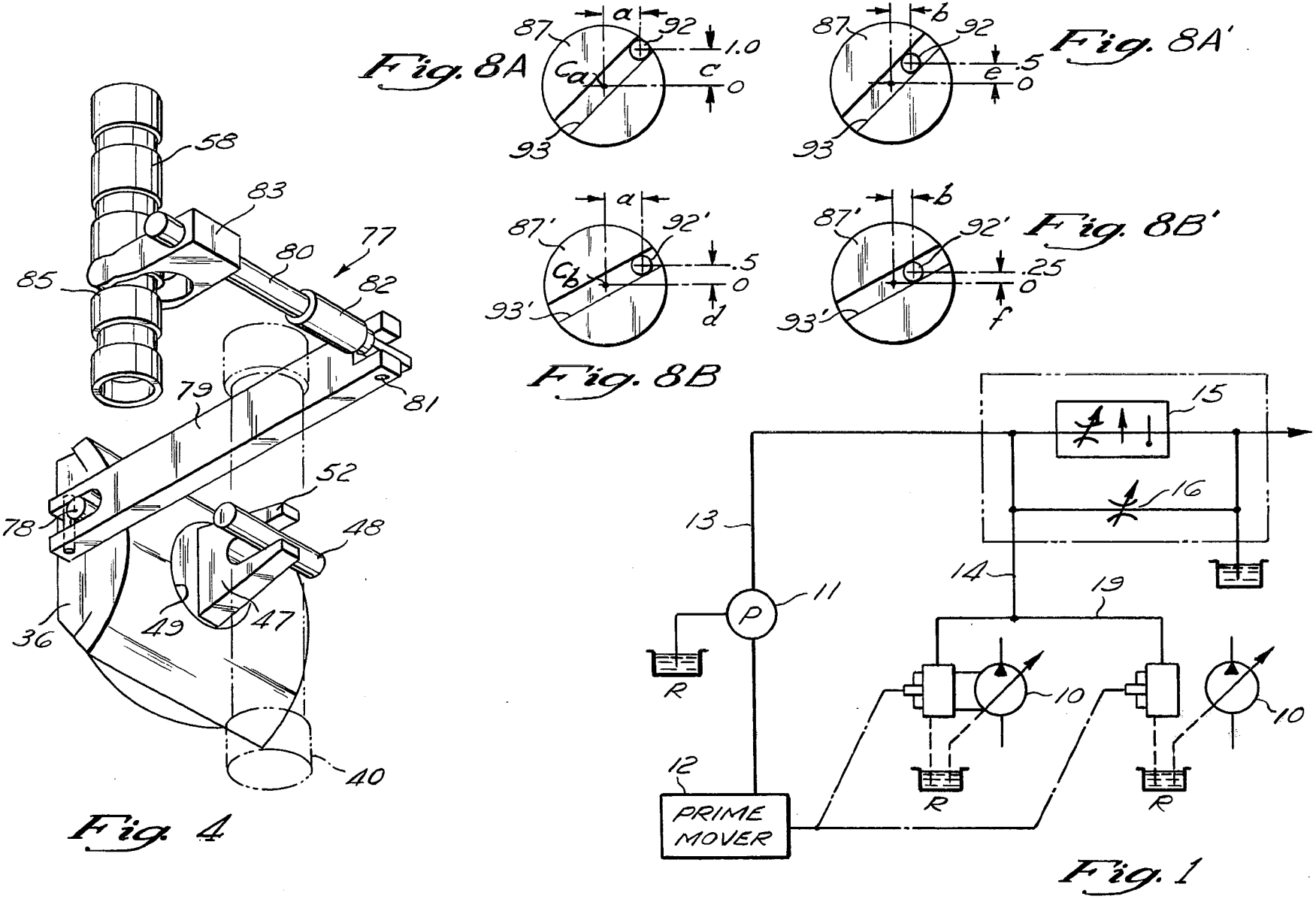
FIG. 1 is a schematic of a hyraulic system incorporating the instant invention.
FIG. 4 is a perspective view of a servo valve feedback linkage connecting the servo valve of FIG. 5 with the displacement changing mechanism shown in FIG. 2.
FIGS. 8A–8B' illustrate the operation of the variable ratio rotary input device.

The instant control system, shown in FIG. 1, comprises a plurality of manually adjustable vriable displacement pumps 10 and a constant volume pump 11 all driven by a prime mover 12 which runs at a contant speed. Each of the variable displacement pumps 10 draws fluid from a reservoir R and supplies it to a consumer such as a hydraulic motor, not shown.

In the instant control system, pump 11 draws fluid from reservoir R and passes pressure fluid through lines 13 and 14 to parallel connected pressure compensated flow control valve 15 and adjustable orifice 16. Flow control valve 15 is set to pass a fixed volume of fluid displaced by pump 11 to reservoir R for all pump displacements above a set minimum. The remainder of the pressure fluid from pump 11 passes through adjustable orifice 16 and creates a signal pressure upstream of orifice 16. When the speed of prime mover 12 drops because of an overload, the consequent drop in output of pump 11 reduces the volume of fluid supplied to orifice 16 which reduces the signal pressure. Likewise, when the overload is removed from prime mover 12 its increase in speed restores the output of pump 11 and increases the signal pressure.

An input device 17 is operatively connected to a servo control valve 18 to change the displacement of each pump 10 in response to a signal pressure change sensed via lines 14, 19 as described below. Valve 15 is sized such that a large percentage of the fluid displaced by pump 11 passes through the valve 15 and a small percentage through orifice 16 so that a relatively small change in the output of pump 11 creates a relatively large pressure change across valve 16 and hence a strong pressure signal to device 17.

Figure 2:
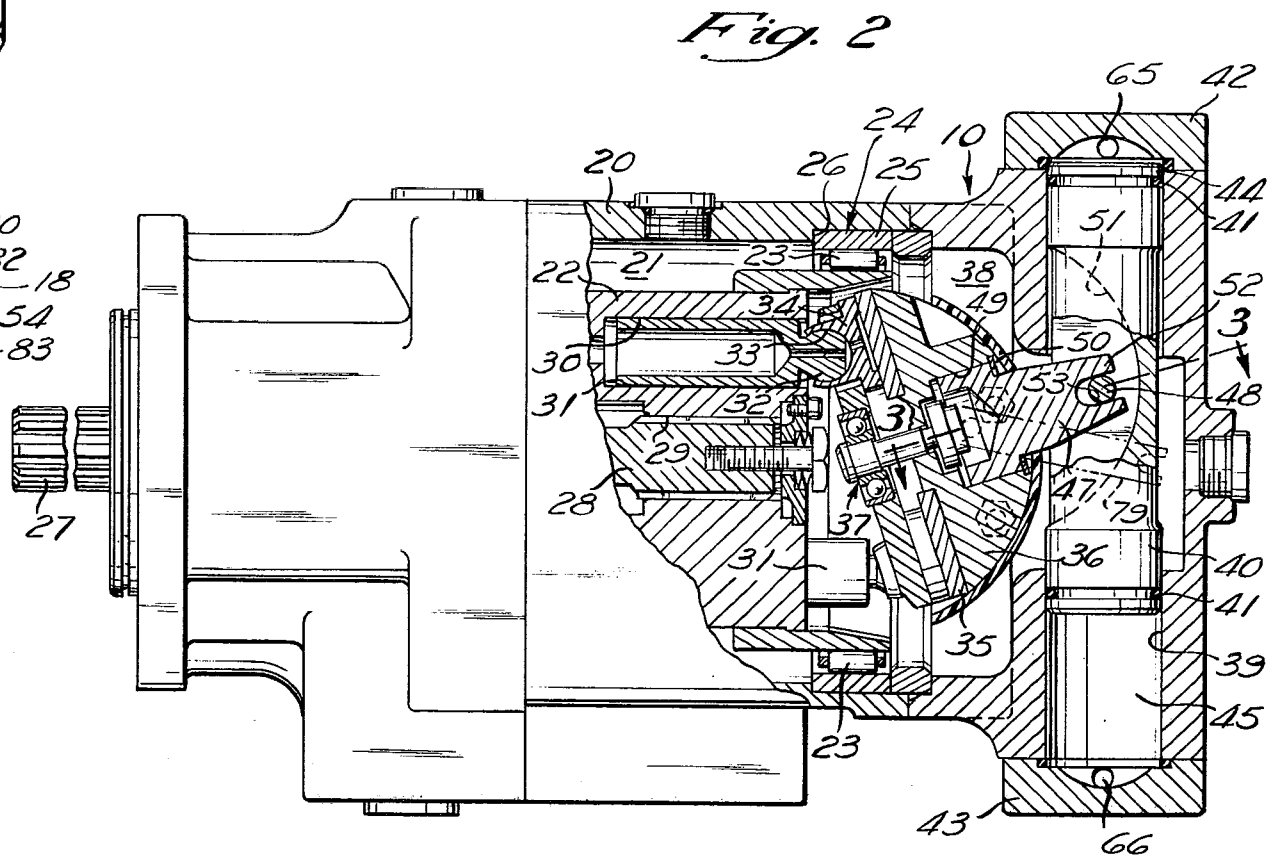
FIG. 2 is a partially broken away view of one of the manually adjustable variable displacement pumps shown in FIG. 1 showing the details of a displacement changing mechanism.
Figure 3:
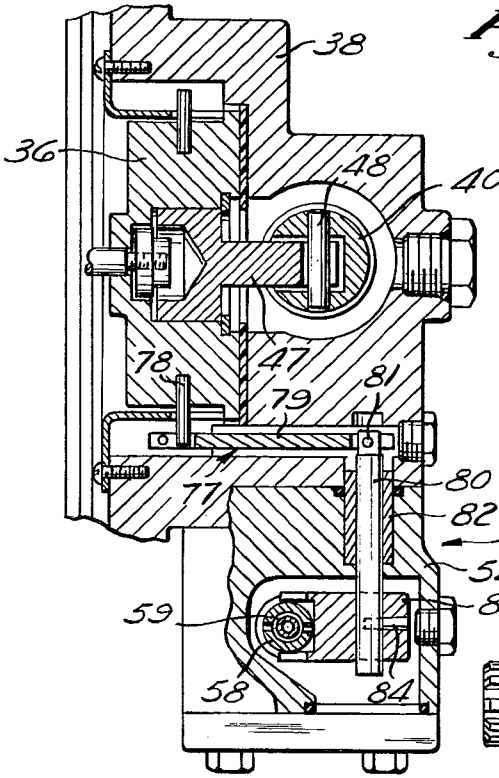
FIG. 3 is a sectional view taken along the line 3—3 of FIG. 2.

Referring to FIGS. 2–4, pump 10 is an axial piston type which has a case 20. Case 20 has a cavity 21 which receives a rotatable cylinder barrel 22 mounted on rollers 23 of a bearing 24 which has an outer race 25 pressed against a case shoulder 26. A drive shaft 27 which is rotatably supported in a bearing at the left side of case 20, not shown, has one end which projects from the case and is connected to the prime mover 12. The other end 28 of drive shaft 27 is splined to a central bore 29 in barrel 22.

Barrel 22 has a plurality of parallel bores 30 each containing a piston 31. Each piston 31 has a ball-shaped head 32 received in a socket 33 of a shoe 34.

The shoes 34 are retained against a flat creep or thrust plate 35 mounted on a movable rocker cam 36 by a shoe retainer assembly 37. Rocker cam 36 is pivoted about a fixed axis perpendicular to the axis of rotation of barrel 22 on a cam cradle 38 by a position control fluid motor to change pump displacement. When rocker cam 36 is inclined from a neutral position normal to the axis of barrel 22 and the barrel is rotated, the pistons 31 will reciprocate in bores 30 to pump fluid in a well-known manner.

The position control fluid motor is located in one end of case 20 and includes a cylinder 39 which receives a double-ended piston 40. O-rings 41 are provided at each end of piston 40. The ends of cylinder 39 are closed by heads 42, 43 which are attached to case 20 by bolts, not shown. Cylinder 39, piston 40 and heads 42, 43 define fluid receiving chambers 44, 45. The position control fluid motor is operated by simultaneously supplying pressurized fluid to one of the chambers 44, 45 and exhausting fluid from the other chamber to move piston 40 in cylinder 39.

The fluid motor is connected to rocker cam 39 through a control arm 47 and a control arm pin 48. A bore 49 in the back of rocker cam 36 forms a socket which receives the base of control arm 47 which is secured by a snap ring 50. Piston 40 has a central, arcuate, cut away section 51 which receives a bifurcated end 52 of arm 47. End 52 is captured by pin 48 located in a bore 53 adjacent section 51 to operatively connect rocker cam 36 and piston 40.

The operation of the position control fluid motor is controlled by a servo or follow-up control valve 18 which regulates the supply of pressurized fluid to fluid receiving chambers 44, 45. Referring now to FIGS. 3–6, servo control valve 18 has a body 54 which is mounted on case 20 in close proximity to rocker cam 36. Body 54 is closed by a top cover 55 and a side plate 56. A bore 57 in body 54 receives a reciprocating follower sleeve 58. A hollow spool 59 is positioned in an axial bore 60 in sleeve 58. Spool 59 can move freely in bore 60 relative to sleeve 58 and sleeve 58 can move freely in bore 57 relative to spool 59.

Figures 5, 6, 7:
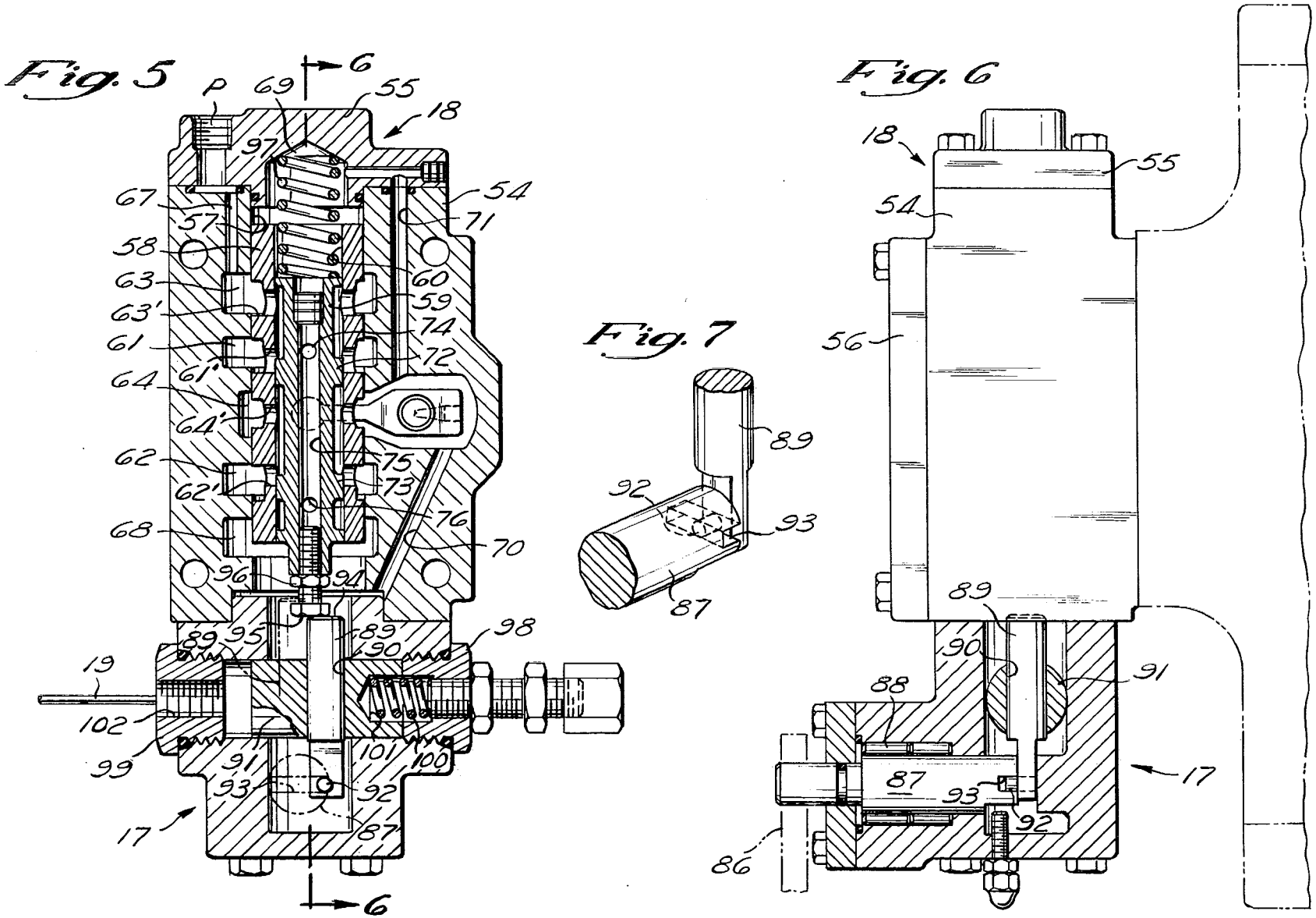
FIG. 5 is an enlarged sectional view of a servo valve and a variable ratio rotary input device.
FIG. 6 is a partial section taken along line 6—6 of FIG. 5.
FIG. 7 is an enlarged perspective view of a portion of the variable ratio rotary input device of FIGS. 5 and 6.

As seen in FIG. 5, a plurality of fluid chambers are formed in body 54. Chambers 61, 62 are connected to fluid receiving chambers 44, 45 respectively, of the position control fluid motor by fluid passages 65, 66 shown in FIG. 2. Chamber 63 is in fluid communication with a passage 67 which receives pressure fluid from a source P and chamber 64 is in fluid communication with reservoir R. Chambers 68, 69 are in communication with low pressure (reservoir) chamber 64 through bores 70, 71 respectively, to provide balancing fluid forces on opposite ends of sleeve 58 and spool 59.

Sleeve 58 has a plurality of ports which communicate with chambers 61–64 and which are identified by identical primed numbers. Spool 59 has a pair of lands 72, 73 which alternatively block or connect ports 61′–64′.

Servo control valve 18 operates position control fluid motor downward, as viewed in FIG. 2, when spool 59 is moved downward relative to sleeve 58 as shown in FIG. 5. In this position, lands 72, 73 are positioned such that all of the ports 61′–64′ are uncovered, pressure fluid chamber 63 is connected to chamber 61, pressure fluid in chamber 61 flows into motor chamber 44 to move piston 40 downward and reservoir chamber 64 is connected to chamber 62 which receives fluid exhausted from motor chamber 45.

Servo control valve 18 operates position control fluid motor upward, as viewed in FIG. 2, when spool 59 is moved upward relative to sleeve 58. In this position, lands 72, 73 are positioned such that all of the ports 61′–64′ are uncovered, pressure fluid chamber 63 is connected to chamber 62 through port 74, bore 75 and port 76, all in spool 59, pressure fluid in chamber 62 flows into motor chamber 45 to move piston 40 upward and reservoir chamber 64 is connected to chamber 61 which receives fluid exhausted from motor chamber 44.

Servo control valve 18 is inoperative when spool 59 and sleeve 92 are in a neutral position in which lands 72, 73 block ports 61′, 62′ to prevent fluid flow to or from chambers 61, 62 and motor chambers 44, 45.

Rocker cam 36 is inclined the maximum in one direction for maximum pump displacement in one direction when spool 59 is at its uppermost position in bore 60 and is inclined the maximum in the other direction for maximum pump displacement in the other direction when spool 59 is at its downmost position in bore 60. Rocker cam 36 is in the vertical (no pump displacement) position when spool 59 is centered in bore 60.

Referring to FIGS. 3 and 4, servo valve 18 has a feedback linkage 77 which moves sleeve 58 to the neutral position with respect to spool 59 when cam 36 reaches a position set by spool 59. A dowel pin 78 which is attached at one end to cam 36 has its other end pivotally connected to a feedback lever 79 which is rigidly connected to a control shaft 80 by a pin 81. Shaft 80 is mounted in a bearing 82 and extends into body 54 of valve 18. A yoke 83 is rigidly attached to the other end of shaft 80 by a key 84. The bifurcated portion of yoke 83 straddles the midsection of follower sleeve 58 and fits into a circumferential groove 85 therein. With this arrangement arcuate movement of cam 36 is transferred through pin 78, lever 79, control shaft 80 and yoke 83 to provide axial movement of sleeve 58. Consequently, when cam 36 reaches the position set by spool 59, feedback linkage 77 has moved sleeve 58 to the neutral position in which ports 61', 62' are blocked and the motor is stopped.

FIGS. 5–8 show a manually operable variable ratio rotary input device 17 which controls the upward and downward displacement of spool 59 for setting the position of piston 40 and rocker cam 36 and automatically adjusts the displacement of pump 10 when prime mover 12 is overloaded. Input device 17 includes a manual input handle 86 connected to a rotary input shaft 87 mounted in a bearing 88. A vertical shaft 89 mounted in a bore 90 of a lateral piston 91 has a pin 92 at one end which engages a slot 93 in shaft 87. The opposite end 94 of shaft 89 engages the head of an adjustment screw 95 which is threaded into the central bore 75 of spool 59 and projects therefrom. Adjustment screw 95 is retained in position by a lock nut 96. A spring 97 biases spool 59 downward and maintains screw 95 in contact with the end 94 of shaft 89. In normal operation, when prime mover 10 is not overloaded, when handle 86 and shaft 87 are rotated the angle of slot 93 is changed and pin 92 and shaft 89 are moved vertically to displace spool 59 which operates the fluid motor as described above. It should be noted that rocker cam 36 is in the vertical (no displacement) position when slot 93 is horizontal and spool 59 is centered in bore 60.

In normal operation, cam 36 is displaced in one direction when handle 86 and shaft 87 are pivoted counterclockwise and the end of slot 93 engaged by pin 92 in angled downward to thereby move spool 59 downward from the centered position as shown in FIG. 5.

Cam 36 is displaced in the other direction when handle 86 and shaft 87 are pivoted clockwise and the end of slot 93 engaged by pin 92 is angled upward to thereby move spool 59 upward from the center position.

Horizontal movement of piston 91 changes the ratio between rotational movement of handle 86 and vertical or linear travel of shaft 89 and spool 59. During normal operation, piston 91 is at the right against stop 98, as shown in FIG. 5, and pin 92 is displaced as far as possible from the center of slot 93. Movement of input handle 86 and corresponding rotation of shaft 87 will cause maximum vertical displacement of shaft 89 and spool 59 in either direction as viewed in FIGS. 5 and 6. Therefore, in this position spool 59 can be moved to either maximum pump displacement position.

When prime mover 10 is overloaded, piston 91 is displaced to the left away from stop 98. If the overload condition continues, piston 91 is moved into contact with stop 99 by a spring 100 acting between stop 98 and one end 101 of piston 91 pin 92 is centered in slot 93 and aligned with the axis of shaft 87. Consequently, movement of input handle 86 and corresponding rotation of shaft 87 will cause no displacement of shaft 89 and spool 59.

When piston 91 is displaced between stops 98 and 99, rotation of input handle 86 and shaft 87 will cause a linear displacement of shaft 89 and spool 59 proportionally less than the maximum, depending upon how far pin 92 is displaced from the center of slot 93.

Operation of a pair of variable ratio rotary input devices 17 under normal operating conditions can be seen by referring to FIGS. 8A and 8B. FIG. 8A shows position 1 of pin 92 and slot 93 of a device 17 with a variable displacement pump 10A set at full displacement and FIG. 8B shows position 1 of an identical pin 92' and slot 93' of another device 17 with a variable displacement pump 10B set at half displacement. Under normal operating conditions signal pressure fluid from line 19 enters port 102 and simultaneously biases piston 91 in each device 17 equal distances to the right against the opposition of sprint 100, as shown in FIG. 5. Therefore, pin 92 is displaced horizontally from the center $C_a$ of shaft 87 the maximum distance $a$ and pin 92' is displaced an equal distance $a$ from the center $C_b$ of shaft 87'. With pump 10A at full displacement 1.0 and pump 10B at half displacement 0.5, pin 92 is displaced vertically from center $C_a$ a distance $c$ which is twice the distance $d$ which pin 92' is displaced from center $C_b$.

Operation of the pair of variable ratio rotary input devices 17 to proportionally change the displacement of pumps 10A and 10B when prime mover 12 is overloaded can be seen by referring to FIGS. 8A' and 8B'. When prime mover 12 is overloaded, the pressure fluid signal acting on piston 91 in each device 17 is insufficient to overcome spring 100. Consequently, spring 100 moves each piston 91 to the left to reduce pump displacement. Since each piston 91 receives an identical signal pressure output, they all move the same distance. Referring to FIGS. 8A' and 8B', assume that piston 91 has moved shaft 89 in each of the pumps 10A and 10B and pins 92, 92' leftward such that distance $b$ is one half distance $a$. When this happens pin 92 is moved down slot 93 to position 2 and pin 92' is moved down slot 93' to position 2. The new displacement $e$ of pump 10A is calculated as follows:

$$\frac{c}{a}=\frac{e}{b}\ ;\ b=\frac{a}{2}\ ;\ \text{by substitution}\ \frac{1.0}{a}=\frac{e}{\frac{a}{2}}$$

$$\text{thus,}\ \underline{e}=\underline{.5}$$

The new displacement $f$ of pump 10B is calculated in a like manner:

$$\frac{d}{a}=\frac{f}{b}\ ;\ b=\frac{a}{2}\ ;\ \text{by substitution}\ \frac{.5}{a}=\frac{f}{\frac{a}{2}}$$

$$\text{thus,}\ \underline{f}=\underline{.25}$$

From the above it can be seen that the displacement of pump 10A has been reduced from 1.0 to 0.5 and the displacement of pump 10B has been reduced from 0.5 to 0.25. Thus, the displacement of both pumps 10A and 10B have been reduced proportionally (i.e. by the same percentage) since 0.5 is 50% of 1.0 and 0.25 is 50% of 0.5.

From the above it can be seen that in the instant control system the displacement of each variable displacement pump 10 is reduced by the same percentage irrespective of the manual setting of displacement. This is because each variable displacement pump 10 has a variable ratio rotary input device 17 which is connected to a servo control valve 18. Each device 17 receives the same pressure signal when prime mover 12 is overloaded. Therefore, each piston 91 is moved the same amount which reduces the displacement of each pump 10 by the same percentage regardless of the manual setting of the input device 17.

Further, the displacement of any pump 10 in the system can be changed manually at any time and the control system will automatically adjust the displacement of all the pumps 10 if the prime mover 12 is overloaded or if an overload is reduced or eliminated. In this way the full power of prime mover 12 is always available to all pumps 10 in the system regardless of their displacements or working pressures.

Also, all pumps 10 can operate at their peak working pressures at all times since only the displacement of the pumps 10 is changed in the instant control system. This allows the pumps 10 to continue doing heavy work when prime mover 12 is overloaded. Only the rate of doing work is changed.

Obviously, those skilled in the art may make various changes in the details and arrangements of parts without departing from the scope of the invention.

We claim:

1. In a control system which includes a prime mover, a plurality of independently adjustable variable displacement pumps driven thereby and an independent control for selectively varying the displacement of each pump, the improvement comprising a load sensing means connected to the prime mover, the load sensing means having an output signal proportional to the load on the prime mover, means connecting the output signal to each independent control, each independent control including input means for selectively setting the displacement of the pump, the input means includes means responsive to said output signal for proportionally changing the displacement of each pump when said output signal reaches a predetermined value which indicates the prime mover is overloaded, the input means further includes a servo valve which operates a fluid motor to set the displacement of the pump and manually operable means for setting the position of the servo valve to thereby set the displacement of the pump, the servo valve further includes a movable valve member and movement of the valve member operates the servo valve between a first position of maximum pump displacement and a second position of minimum pump displacement, and the manually operable means includes movable setting means which operates the valve member and a ratio changing device which changes the ratio between the amount of movement of the setting means and the amount of corresponding movement of the valve member.

2. The control recited in claim 1, wherein the movable valve member is a linearly movable spool and the movable setting means includes a rotary member and a linear operator which engages the spool.

3. The control recited in claim 1, wherein the ratio changing device includes means for automatically moving the movable valve member towards a position of lesser pump displacement than set by the movable setting member when the output signal is at the predetermined value and the automatic moving means operates without changing the setting of the movable setting member.

4. The control recited in claim 1, wherein the ratio changing device includes means for automatically moving the valve member to provide the maximum pump displacement between the second position and the amount set by the movable setting member that does not overload the prime mover.

5. The control recited in claim 2, wherein one of the rotary member and the linear operator has a slot and the other has a pin which projects into the slot to thereby connect the rotary member with the linear operator to provide movement of the spool when the rotary member is operated and the ratio changing device operates to move one of the rotary member and the linear operator relative to the other to change the position of the pin in the slot and thereby change the amount of displacement of the linear operator and the spool per amount of rotation of the rotary member.

6. The control recited in claim 5, wherein the ratio changing device includes a slidable piston in communication with said output and movable in response to changes in the output, the piston being connected to the linear operator and the piston is operable between a first position in which the linear operator is movable to displace the spool to the maximum pump displacement position when the rotary member is operated and a second position in which the linear operator is unable to displace the spool and the spool remains set to the minimum pump displacement position when the rotary member is operated.

* * * * *

UNITED STATES PATENT OFFICE

CERTIFICATE OF CORRECTION

PATENT NO. : 4,017,219

DATED : April 12, 1977

INVENTOR(S) : Ellis H. Born; David L. Thurston

It is certified that error appears in the above-identified patent and that said Letters Patent are hereby corrected as shown below:

Col. 2, line 63 - "vriable" should read --variable--

Col. 5, line 41 - "in" should read --is-- line 63 - after "piston 91" insert --. In this position of piston 91--

Col. 6, line 17 - "sprint" should read --spring--

Col. 5, lines 30 and 59:

The reference numeral "10" for the prime mover should read ---12---.

Signed and Sealed this

Twenty-first Day of June 1977

[SEAL]

*Attest:*

RUTH C. MASON
*Attesting Officer*

C. MARSHALL DANN
*Commissioner of Patents and Trademarks*